US006425959B1

(12) United States Patent
Man

(10) Patent No.: US 6,425,959 B1
(45) Date of Patent: Jul. 30, 2002

(54) DETERGENT COMPOSITIONS FOR THE REMOVAL OF COMPLEX ORGANIC OR GREASY SOILS

(75) Inventor: Victor F. Man, St. Paul, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 09/339,601

(22) Filed: Jun. 24, 1999

(51) Int. Cl.[7] ..... B08B 3/04; C11D 1/66; C11D 1/75; C11D 3/16

(52) U.S. Cl. ..... 134/39; 510/222; 510/223; 510/225; 510/228; 510/229; 510/230; 510/466; 510/506; 510/422; 510/424

(58) Field of Search ..... 510/222, 223, 510/225, 228, 229, 230, 336, 339, 340, 342, 356, 357, 360, 367, 466, 506, 514, 422, 424; 134/25.2, 39, 40; 8/137

(56) References Cited

U.S. PATENT DOCUMENTS

| | | | | |
|---|---|---|---|---|
| 4,005,024 A | | 1/1977 | Rodriguez et al. | 252/89 R |
| 4,654,161 A | | 3/1987 | Kollmeier et al. | 252/174.15 |
| 4,818,421 A | | 4/1989 | Boris et al. | 252/8.8 |
| 4,822,854 A | | 4/1989 | Ciolino | 252/174.19 |
| 5,236,615 A | | 8/1993 | Trinh et al. | 252/179.11 |
| 5,288,431 A | | 2/1994 | Huber et al. | 252/548 |
| 5,308,551 A | | 5/1994 | Beauquey et al. | 252/548 |
| 5,439,609 A | | 8/1995 | Paszek | 252/174.15 |
| 5,501,815 A | * | 3/1996 | Man | 252/174.17 |
| 5,514,302 A | | 5/1996 | Brown | 252/545 |
| 5,536,332 A | | 7/1996 | Chun | 132/202 |
| 5,603,776 A | * | 2/1997 | Lentsch et al. | 134/25.2 |
| 5,607,908 A | | 3/1997 | Potini et al. | 510/115 |
| 5,690,920 A | | 11/1997 | Dubief | 424/70.12 |
| 5,747,435 A | | 5/1998 | Patel | 510/119 |
| 5,753,607 A | | 5/1998 | Burke et al. | 510/242 |
| 5,759,983 A | | 6/1998 | Mondin et al. | 510/365 |
| 5,880,089 A | * | 3/1999 | Lentsch et al. | 510/514 |
| 6,156,715 A | * | 12/2000 | Lentsch et al. | 510/224 |
| 6,164,296 A | * | 12/2000 | Lentsch et al. | 134/25.2 |

FOREIGN PATENT DOCUMENTS

| | | |
|---|---|---|
| EP | 0 875 556 A2 | 11/1998 |
| GB | 2200365 A | 8/1988 |
| WO | WO 98/30662 | 7/1998 |

* cited by examiner

*Primary Examiner*—Gregory Delcotto
(74) *Attorney, Agent, or Firm*—Merchant & Gould P.C.

(57) ABSTRACT

Organic compositions, used neat or in concentrate, are effective in removing complex organic soils from wood, metal and other hard surfaces. The compositions comprise nonionic surfactants, silicone surfactants, hydrotropes and other optional functional materials including sequestrants. Substrates such as laundry and heavily soiled hard surfaces containing a substantial proportion of organic/inorganic soils such as greases, oils and other hard to remove soil materials are readily cleaned by the cleaner compositions of the invention.

10 Claims, No Drawings

DETERGENT COMPOSITIONS FOR THE REMOVAL OF COMPLEX ORGANIC OR GREASY SOILS

FIELD OF THE INVENTION

The invention relates to cleaning compositions and formulations that can be used neat or can be readily diluted and applied to a variety of substrates including fabric, ware, soiled metal, wood or other hard surfaces. The compositions are suitable for combination with a fully formulated cleaner to provide grease removal and similar soil removal properties. The compositions are suitable for application to soiled surfaces for a sufficient period of time to loosen and remove any organic or greasy soil deposits from hard surfaces. The common target soil comprises combined organic/inorganic soils having a large organic component such as oils, fats, and other substantially aqueous insoluble organic media. Such soils can often contain a substantial proportion of an inorganic component suspended or dispersed within the organic component. Such inorganic materials can include common ordinary dirt or other inorganic particulate such as lubricants, clays, pigments, fillers, etc. Such complex soils can also include fatty materials, silicone semi-solid and liquid materials, formulated lubricants, grease blends, high pressure greases and other liquid or semi-solid functional materials having a substantially solid or semi-liquid organic base with dispersed inorganic solids.

BACKGROUND OF THE INVENTION

Removal of thickened liquid, semi-solid or solid organic soils, from a variety of substrates including porous surfaces such as fabric or hard surfaces, has been a problem posed to formulators of cleaners generally and aqueous cleaning materials for many years. A large variety of cleaning materials have been used to attempt removal of such complex organic/inorganic soils from hard surfaces. Cleaning compositions can include straight solvent based materials that simply remove soils on a solvent/solute basis. Such solvents include low boiling aliphatic hydrocarbons, chlorinated hydrocarbon solvents, organic aromatic solvents, etc. Solvent based cleaners simply remove such complex organic soils by dissolving the organic soil in a large proportion of solvent. Such methods can damage the substrate, can be dangerous due to solvent flammability, can involve exposure to toxic substances and can be expensive or time consuming. Aqueous cleaners for such soils can comprise an aqueous formulation of a variety of ingredients or can comprise high pressure steam, etc. A number of aqueous cleaner compositions have been developed, however, many aqueous cleaners are simply not capable of substantial cleaning capacity when faced with heavy deposits of complex organic/inorganic soils on hard surfaces. The use of high temperature steam cleaners also poses risks of contact with steam resulting in personal injury.

Further, the type of substrate also has an effect on soil removability. Fabric substrates common in uniforms used in automotive, mechanical, food processing, rendering and other activities can acquire or accumulate large quantities of hydrophobic or greasy, thickened or semi-solid, organic soils. Such soils are difficult to remove from porous woven and non-woven fabrics common in uniforms, shop rags, towels and other fabrics useful in such activities. Cleaning such complex organic or greasy soils from such woven or non-woven fabrics has been a challenge for cleaning processes for many years.

The prior art discloses certain compositions that comprise aqueous formulations of a variety of functional materials in a cleaning regimen. Dubief, U.S. Pat. No. 5,690,920 discloses a cleaning composition for personal use on hair and skin comprising an insoluble silicone selected from silicone gums, silicone resins and organomodified silicones, an alkylpolyglycoside and other materials to obtain a high foaming personal care cleaner material. Beauquey et al., U.S. Pat. No. 5,308,551 teach compositions similar to that shown in Dubief, but also includes a myristate of a $C_2$–$C_4$ polyhydric alcohol, alkanolamide/alkylethers, etc. Lentsch et al., U.S. Pat. No. 5,603,776 teach plasticware cleaning compositions using a nonionic surfactant, a fluorinated hydrocarbon surfactant and a polyalkyleneoxide modified polydimethylsiloxane. Lastly, Vesterager, GB 2 200 365 broadly discloses largely laundry detergent compositions that can be made from virtually any one of a vast spectrum of disclosed compositions.

These patents show formulations containing surfactants and other functional materials that do not effectively clean in all cleaning environments. A substantial need remains for formulation development that can adequately remove heavy deposits of complex organic/inorganic soils from hard surfaces with minimal mechanical action, agitation or other energy input. In a preferred mode, the cleaning composition is directly applied to a heavy soil deposit, permitted to soften and promote soil removal. Once the composition has been permitted to enhance the removability of the soil, the cleaner and removed soil can be readily removed with a rinse step.

BRIEF DISCUSSION OF THE INVENTION

The compositions and methods of the invention are uniquely capable of removing complex organic or greasy soils from a variety of substrates. The compositions of the invention can be used neat (i.e., without diluent such as an aqueous diluent) or can be diluted with water or other liquid medium to form a degreasing aqueous solution. Further, the degreasing compositions of the invention can be used as an additive with other formulated cleaning compositions for cleaning substrates. In a first aspect of the invention, the invention involved compositions and methods comprising a nonionic surfactant, a nonionic silicone surfactant, and a hydrotrope, preferably an amine oxide material which is preferably used neat, without diluent, to remove complex oily or greasy organic soils from typically hard metallic or other hard surfaces. Such hard surfaces include any mechanical surface that comes into contact with large proportions of complex organic soils such as oily or greasy lubricants. Such surfaces include surfaces on vehicles such as cars, buses, trucks, trains, airplanes, ships, helicoptors, etc. Other surfaces are surfaces such as railroad or other parallel track conveyances, auto lifts, mechanical conveyor belts, manufacturing production lines, military installations such as aircraft carrier surfaces (metal, wood or polymer composite) or lifts, tanks, armor personnel carriers, humvee vehicles, troop transports, armored vehicle transports, and other applications of heavy organic or greasy soils in industry. The common hard substrate for use in this aspect typically involves metal, composite, plastic or wood surfaces that accumulate a substantial quantity of the solid or semi-solid organic or greasy soil which can be removed by the direct application of the composition of the invention preferably at 100% strength without any substantial aqueous diluent.

A second aspect of the invention involves using compositions of the invention as an additive in a fully formulated product that is used in aqueous solution for organic or greasy soil removal. In such applications, the composition of the invention is combined in an aqueous solution with a variety of ingredients that are designed for removing soil from a particular substrate. Such substrates include laundry substrates having a high concentration of organic oily or greasy soils. Another substrate used with formulated aqueous cleaners include common hard surfaces. Such hard surfaces can exist in food surface applications, the household, offices, hospitals and other locations where food soils or other greasy soils can accumulate on hard surfaces. Such surfaces can be cleaned using a formulated hard surface cleaning that can also include the composition of the invention as a degreasing or organic soil removing component. The surprising nature of these compositions of the invention is that the soil removing capacity of the materials are not substantially removed or reduced.

The cleaning compositions of the invention comprise about 0.1 to 10 parts by weight of a blended surfactant composition containing a nonionic surfactant preferably free of a silicone moiety, a block (EO)(PO) copolymer, an alcohol alkoxylate or an alkyl phenol alkoxylate, wherein alkoxylate is an (EO) or (PO) moiety, and a nonionic silicone surfactant, the weight ratio of the nonionic surfactant to the nonionic silicone surfactant is such that there are about 1 to about 10 parts by weight, preferably 3 to 7 parts of the nonionic surfactant or blend thereof per each one part by weight of the silicone surfactant; and about 10 to 0.1 parts by weight of an effective hydrotrope, preferably an alkyl di-methyl amine oxide, to maintain the chelating agent and the surfactant blend in a uniform single phase aqueous composition, the weights based on one million parts of the cleaner composition. In another view of the concentrate compositions of the invention, the composition can comprise about 1 to about 15 wt % of a nonionic silicone surfactant, about 5 to about 75 wt % of a nonionic surfactant and about 2 to 75 wt % of a hydrotrope solubilizer, preferably an amine oxide material. In these compositions, the ratio between the nonionic surfactant and the nonionic silicone surfactant is such that there are about 3 to 7 parts by weight of a nonionic surfactant per each part by weight of the nonionic silicone surfactant. This balance of materials in the composition provides enhanced cleaning properties.

When used in a dilute aqueous formulated composition, the aqueous solution can contain from about 0.005 to 35 wt % or about 0.1 to about 10 wt % of the silicone surfactant, about 0.0003 to 35 wt % or about 0.3 to 30 wt % of the nonionic surfactant and about 0.001 to 20 wt % or 0.2 to about 30 wt % of the hydrotrope solubilizer while maintaining the ratio of nonionic to silicone surfactant as set forth above.

We have found surprisingly that this unique combination of materials is highly effective in removing heavy soil deposits of a complex organic and inorganic soil when compared to the compositions of the prior art. Further, we have surprisingly found that this dilute aqueous cleaning composition is more active in soil removal than a similar formulation having higher concentrations of the cleaning components. The invention also resides, in part, in a method of cleaning complex organic soils from hard surfaces which comprises a step in which a cleaner concentrate can be diluted with water to form a dilute active aqueous cleaner composition. The cleaner concentrate can comprises in an aqueous base, (a) about 0.003 to 35 wt % or about 0.1 to 25 wt % of a chelating agent or sequestering agent; (b) about 0.003 to 35 wt % or about 0.3 to 30 wt % of a nonionic surfactant; (c) about 0.0005 to 35 wt % or about 0.01 to 10 wt % of a nonionic silicone surfactant; and (d)-about 0.001 to 20 wt % or about 0.2 to 30 wt % of a hydrotrope or surfactant solubilizer composition preferably containing an amine oxide, the percentages based on the cleaner composition. This cleaner concentrate can be used neat or can be diluted with service water at a sufficient proportion to obtain the dilute active aqueous cleaner set forth above. In the context of the invention, the term "neat" indicates the substantial absence of a diluent such as an aqueous medium. The resulting dilute cleaner is applied to the soiled substrate for soil removal. For the purpose of this application, the term "complex organic/inorganic soil" refers to a soil comprising a large proportion of the organic liquid, semi-solid or solid material. Such materials can include natural fats and oils, petroleum fats and oils, waxes, etc. The soil can also include an inorganic component such as ordinary dirt or environmental particulates such as dust or can include solids derived from the formulation of a complex material such as a lubricant, grease or oil. Such solids can include calcium oxide, calcium carbonate, molybdenum compounds, antimony compounds, and other inorganics common in extreme or high pressure grease formulations. Common soils include formulated automotive and high pressure or extreme pressure greases, fatty soils, lubricant oils, inks, coatings, etc. Service water is water available form the local water utility.

For the purpose of this patent application, the cleaning compositions can comprise a chelating agent, a nonionic/nonionic silicone surfactant blend and a hydrotrope (preferably containing an amine oxide) when needed for soil removal and when used on a corrosion resistant surface. The chelating agents can be used in the form of sodium or potassium salt of the chelating agent. Similarly, the hydrotrope can be blended as a sodium or potassium salt of a hydrotrope or blend thereof. The claims are intended to, and indeed, cover compositions in which the metal ions of the ingredients and metal ions of the soil can interact with other components of the compositions of the invention and can rearrange within the composition after formulation to become part of the chelating agent, the surfactant composition or the hydrotrope. Any recombination of a cation from one composition to the other does not change the underlying chemical nature of the composition. One example of such a rearrangement or recombination is the change in sodium associated with the chelating agent as the pH of the systems are modified with an acid.

DETAILED DISCUSSION OF THE INVENTION

The concentrate and the dilute aqueous cleaning compositions of this invention include an effective concentration of a blended surfactant comprising a nonionic surfactant and a silicone surfactant and a hydrotrope or solubilizer to maintain a single phase non-separating aqueous solution or suspension. The essential ingredients are as follows:

Concentrate Composition

| Chemical | Useful Percent Range wt % | Preferred Percent Range wt % | Most Preferred Percent Range wt % |
|---|---|---|---|
| Chelating Agent | 0 to 30 | 0.5 to 15 | 0.5 to 15 |
| Silicone Surfactant | 0.1 to 35 | 0.1 to 10 | 1 to 7 |
| Nonionic Surfactant | 0.5 to 35 | 1 to 20 | 1 to 15 |
| Hydrotrope | 0.1 to 20 | 0.5 to 15 | 0.5 to 10 |

-continued

| Dilute Aqueous Composition (as is or as formulation additive) | | | |
|---|---|---|---|
| Chemical | Useful Range (ppm) | Preferred Range (ppm) | Most Preferred Range (ppm) |
| Chelating Agent | 0 to 150,000 | 600 to 20,000 | 1200 to 10,000 |
| Surfactant blend | 30 to 175,000 | 3000 to 100,000 | 6000 to 50,000 |
| Hydrotrope | 10 to 100,000 | 1000 to 60,000 | 2000 to 20,000 |
| Aqueous diluent | Bal. | Bal. | Bal. |

The tables above show useful and preferred compositions that can be used as the organic soil or grease remover of the invention. The surfactant blends set forth above refer to the combination of a nonionic and a silicone nonionic surfactant at the ratios disclosed above. Further, chelating agents are useful but not necessary. Chelating agents provide chelation and soil removal, but can often contribute to corrosion or other chemical harm to certain surfaces.

| Preferred Concentrate Composition | | |
|---|---|---|
| Chemical | Useful Percent Range wt % | Preferred Percent Range wt % |
| Chelating Agent | 0.1 to 30 | 0.5 to 15 |
| Surfactant blend | 0.5 to 70 | 1 to 30 |
| Amine Oxide | 0.1 to 20 | 0.5 to 15 |
| Hydrotrope | | |
| Optional Acid | to ≧ pH 9 | to ≧ pH 10 |

| Preferred Dilute Aqueous Composition | | |
|---|---|---|
| Chemical | Useful Range (ppm) | Preferred Range (ppm) |
| Chelating Agent | 6 to 70,000 | 600 to 20,000 |
| Surfactant blend | 30 to 350,000 | 3000 to 100,000 |
| Amine Oxide | 7 to 80,000 | 700 to 25,000 |
| Hydrotrope | | |
| Optional Acid | to ≧ pH 9 | to ≧ pH 10 |
| Water | Bal. | Bal. |

The active cleaning compositions of the invention can comprise a polyvalent metal complexing, sequestering or chelating agent that aids in metal compound soil removal and in reducing harmful effects of hardness components in service water. Typically, a polyvalent metal cation or compound such as a calcium, a magnesium, an iron, a manganese, a molybdenum, etc. cation or compound, or mixtures thereof, can be present in service water and in complex soils. Such compounds or cations can comprise a stubborn soil or can interfere with the action of either washing compositions or rinsing compositions during a cleaning regimen. A chelating agent can effectively complex and remove such compounds or cations from soiled surfaces and can reduce or eliminate the inappropriate interaction with active ingredients including the nonionic surfactants of the invention. Both organic and inorganic chelating agents are common and can be used. Inorganic chelating agents include such compounds as sodium tripolyphosphate and other higher linear and cyclic polyphosphates species. Organic chelatinagents include both polymeric and small molecule chelating agents. Organic small molecule chelating agents are typically organocarboxylate compounds or organophosphate chelating agents. Polymeric chelating agents commonly comprise polyanionic compositions such as polyacrylic acid compounds. Small molecule organic chelating agents include N-hydroxyethylenediaminetriacetic acid (HEDTA), ethylenediaminetetraacetic acid (EDTA), nitrilotriaacetic acid (NTA), diethylenetriaminepentaacetic acid (DTPA), ethylenediaminetetraproprionic acid, triethylenetetraaminehexaacetic acid (TTHA), and the respective alkali metal, ammonium and substituted ammonium salts thereof. Aminophosphonates are also suitable for use as chelating agents in the compositions of the invention and include ethylenediaminetetramethylene phosphonates, nitrilotrismethylene phosphonates, diethylenetriamine-(pentamethylene phosphonate). These aminophosphonates commonly contain alkyl or alkenyl groups with less than 8 carbon atoms. Other suitable sequestrants include water soluble polycarboxylate polymers used to condition the wash solutions under end use conditions. Such homopolymeric and copolymeric chelating agents include polymeric compositions with pendant (—$CO_2H$) carboxylic acid groups and include polyacrylic acid, polymethacrylic acid, polymaleic acid, acrylic acid-methacrylic acid copolymers, acrylic-maleic copolymers, hydrolyzed polyacrylamide, hydrolyzed methacrylamide, hydrolyzed acrylamide-methacrylamide copolymers, hydrolyzed polyacrylonitrile, hydrolyzed polymethacrylonitrile, hydrolyzed acrylonitrile methacrylonitrile copolymers, or mixtures thereof. Water soluble salts or partial salts of these polymers or copolymers such as their respective alkali metal (for example, sodium or potassium) or ammonium salts can also be used. The weight average molecular weight of the polymers is from about 4000 to about 12,000. Preferred polymers include polyacrylic acid, the partial sodium salts of polyacrylic acid or sodium polyacrylate having an average molecular weight within the range of 4000 to 8000. Also useful as sequestrants are alkali metal phosphates, condensed and cyclic phosphates, phosphonic acids and phosphonic acid salts. Useful phosphates include alkali metal pyrophosphate, an alkali metal polyphosphate such a sodium tripolyphosphate (STPP) available in a variety of particle sizes. Such useful phosphonic acids include, mono, di, tri and tetra-phosphonic acids which can also contain other functional groups such as carboxy, hydroxy, thio and the like. Among these are phosphonic acids having the generic formula motif $R_1N[CH_2PO_3H_2]_2$ or $R_2C(PO_3H_2)_2OH$, wherein $R_1$ may be -[(lower $C_{1-6}$)alkylene]-N—$[CH_2PO_3H_2]_2$ or a third —$(CH_2PO_3H_2)$ moiety; and wherein $R_2$ is selected from the group consisting of a lower ($C_1$–$C_6$) alkyl. The phosphonic acid may also comprise a low molecular weight phosphonopolycarboxylic acid such as one having about 2–4 carboxylic acid moieties and about 1–3 phosphonic acid groups. Such acids include 1-hydroxyethane-1,1-diphosphonic acid $CH_3C(OH)[PO(OH)_2]_2$; aminotri (methylenephosphonic acid) $N[CH_2PO(OH)_2]_3$; aminotri (methylenephosphonate), sodium salt

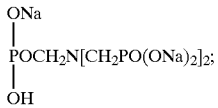

2-hydroxyethyliminobis(methylenephosphonic acid) $HOCH_2CH_2N[CH_2PO(OH)_2]_2$; diethylenetriaminepenta (methylenephosphonic acid) $(HO)_2POCH_2N[CH_2CH_2N[CH_2PO(OH)_2]_2]_2$; diethylenetriaminepenta (methylenephosphonate), sodium salt $C_9H_{(28-x)}N_3Na_xO_{15}P_5$ (x=7); hexamethylenediamine(tetramethylenephosphonate), potassium salt $C_{10}H_{(28-x)}N_2K_xO_{12}P_4$ (x=6); bis (hexamethylene)triamine(pentamethylenephosphonic acid) $(HO_2)POCH_2N[(CH_2)_6N[CH_2PO(OH)_2]_2]_2$; and phosphorus acid $H_3PO_3$. The preferred phosphonate is aminotrimethylenephosphonic acid or salts thereof combined optionally with diethylenetriaminepenta(methylenephosphonic acid).

These preferred chelating agents are characterized by a strong chelating character. The strong chelating character is quantified using a stability constant ($K_f$). In the complexing reaction $M^+L^- \leftrightarrows M-L$. The constant $K_f$ provides a measure of relative chelation strength where $K_f=[M-L]/[M^+][L^-]$ and $K_f$ is selected to be stronger than average.

The nonionic blended surfactant of the invention can comprise a nonionic surfactant and a silicon surfactant. The silicone surfactant comprises a modified dialkyl, preferably a dimethyl polysiloxane. The polysiloxane hydrophobic group is modified with one or more pendent hydrophilic polyalkylene oxide group or groups. Such surfactants provide low surface tension, high wetting, high spreading, antifoaming and excellent stain removal. The silicone surfactants of the invention comprise a polydialkyl siloxane, preferably a polydimethyl siloxane to which polyether, typically polyalkylene oxide, groups have been grafted through a hydrosilation reaction. The process results in an alkyl pendent (AP type) copolymer, in which the polyalkylene oxide groups are attached along the siloxane backbone through a series of hydrolytically stable Si—C bond.

These nonionic substituted poly dialkyl siloxane products have the following generic formula:

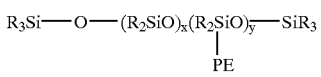

wherein PE represents a nonionic group, preferably $—CH_2—(CH_2)_p—O—(EO)_m(PO)_n—Z$, EO representing ethylene oxide, PO representing propylene oxide, x is a number that ranges from about 0 to about 100, y is a number that ranges from about 1 to 100, m, n and p are numbers that range from about 0 to about 50, $m+n \geqq 1$ and Z represents hydrogen or R wherein each R independently represents a lower ($C_{1-6}$) straight or branched alkyl. Such surfactants have a molecular weight ($M_n$) of about 500 to 2500.

Other silicone nonionic surfactants have the formula:

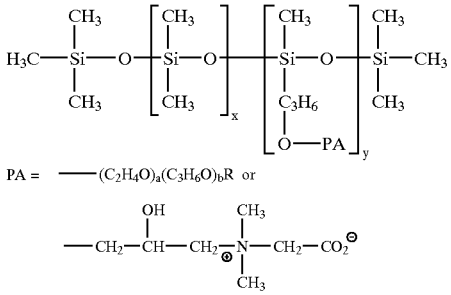

wherein x represent a number that ranges from about 0 to about 100, y represent a number that ranges from about 1 to about 100, a and b represent numbers that independently range from about 0 to about 60, $a+b \geqq 1$, and each R is independently H or a lower straight or branched ($C_{1-6}$) alkyl. A second class of nonionic silicone surfactants is an alkoxy-end-blocked (AEB type) that are less preferred because the Si—O— bond offers limited resistance to hydrolysis under neutral or slightly alkaline conditions, but breaks down quickly in acidic environments.

Preferred surfactants are sold under the SILWET® tradename, the TEGOPREN® trademark or under the ABIL® B trademark. One preferred surfactant, SILWET® L77, has the formula:

$$(CH_3)_3Si—O(CH_3)Si(R^1)O—Si(CH_3)_3$$

wherein $R^1=—CH_2CH_2CH_2—O—[CH_2CH_2O]_zCH_3$; wherein z is 4 to 16 preferably 4 to 12, most preferably 7–9. Other preferred surfactants include TEGOPREN 5840® and ABIL B-8852®.

A particularly useful class of nonionic surfactants include the class defined as alkoxylated amines or, most particularly, alcohol alkoxylated/aminated/alkoxylated surfactants.

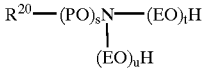

wherein $R^{20}$— is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2–5, t is 1–10, preferably 2–5, and u is 1–10, preferably 2–5. Other variations on the scope of these compounds may be represented by the alternative formula:

$$R^{20}—(PO)_v—N[(EO)_wH][(EO)_zH]$$

wherein $R^{20}$ is as defined above, v is 1 to 20 (e.g., 1, 2, 3 or 4 [preferably 2]), and w and z are independently 1–10 and preferably 2–5.

These compounds are represented commercially by a line of products sold by Huntsman Chemicals as nonionic surfactants. A preferred chemical of this class includes Surfonic™ PEA 25 Amine Alkoxylate.

An example of useful nonionic surfactants used with the silicone surfactants are polyether compounds prepared from ethylene oxide, propylene oxide, in a graft moiety homopolymer or a block or heteric copolymer. Such polyether compounds are known as polyalkylene oxide polymers, polyoxyalkylene polymers, or polyalkylene glycol polymers. Such nonionic surfactants have a molecular weight in the range of about 500 to about 15,000. Certain types of polyoxypropylene-polyoxyethylene glycol polymer nonionic surfactants have been found to be particularly useful. Surfactants comprising least one block of a polyoxypropylene and having at least one other block of polyoxyethylene attached to the polyoxypropylene block can be used. Additional blocks of polyoxyethylene or polyoxypropylene can be present in a molecule. These materials having an average molecular weight in the range of about 500 to about 15,000 are commonly available as PLURONIC® manufactured by the BASF Corporation and available under a variety of other trademarks of their chemical suppliers. In addition PLURONIC® R (reverse PLURONIC structure) are also useful in the compositions of the invention. Additionally, alkylene oxide groups used with an alcohol and an alkyl phenol, a fatty acid or other such group can be useful. One particularly useful surfactant can comprise a capped polyalkoxylated $C_{6-24}$ linear alcohol. The surfactants can be made with polyoxyethylene or polyoxypropylene units and can be capped with common agents forming an ether end group. One particularly useful species of this surfactant is a $(PO)_x$ compound or benzyl ether compound polyethoxylated $C_{12-14}$ linear alcohol; see U.S. Pat. No. 3,444,247. Particularly useful polyoxypropylene polyoxyethylene block polymers are those comprising a center block of polyoxypropylene units and blocks of polyoxyethylene units to each side of the center block.

These copolymers have the formula shown below:

$$(EO)_n—(P)O)_m—(EO)_n$$

wherein m is an integer of 21 to 54; n is an integer of 7 to 128. Additional useful block copolymers are block polymers having a center block of polyoxyethylene units and blocks of polyoxypropylene units to each side of the center block. The copolymers have the formula as shown below:

$$(PO)_n—(EO)_m—(PO)_n$$

wherein m is an integer of 14 to 164 and n is an integer of 9 to 22.

One important nonionic surfactant for use in the compositions of the invention include an alkyl phenol alkoxylate of the formula:

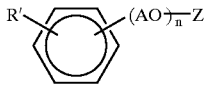

wherein $R^1$ comprises a $C_{2-24}$ aliphatic group and AO represents an ethylene oxide group, a propylene oxide group, an heteric mixed EOPO group or a block EO—PO, PO—EO, EOPOEO or POEOPO group, and Z represents H or an (AO), Benzyl or other cap. A preferred nonionic surfactant comprises an alkyl phenol ethoxylate of the formula:

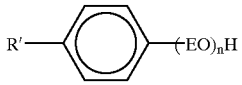

wherein $R^1$ comprises a $C_{6-18}$ aliphatic group, preferably a $C_{6-12}$ aliphatic group and n is an integer of about 2 to about 24. A primary example of such a surfactant is a nonyl phenol ethoxylate having 2.5 to 14.5 moles of EO in the ethoxylate group. The ethoxylate group can be capped with a $(PO)_x$ group when x is 2.5 to 12.5 or a benzyl moiety.

A hydrotropic agent is often employed in the formulation to maintain a single phase neat or aqueous composition. Such an agent may also be used in the present invention. Hydrotropy is a property that relates to the ability of materials to improve the solubility or miscibility of a substance in liquid phases in which the substance tends to be insoluble. Substances that provide hydrotropy are called hydrotropes and are used in relatively lower concentrations than the materials to be solubilized. A hydrotrope modifies a formulation to increase the solubility of an insoluble substance or creates micellar or mixed micellar structures resulting in a stable suspension of the insoluble substance. The hydrotropic mechanism is not thoroughly understood. Apparently either hydrogen bonding between primary solvent, in this case water, and the insoluble substance are improved by the hydrotrope or the hydrotrope creates a micellar structure around the insoluble composition to maintain the material in a suspension/solution. In this invention, the hydrotropes are most useful in maintaining the formulae components a uniform solution both during manufacture and when dispersed at the use location. The nonionic blended surfactant of the invention alone or especially when combined with the chelating agent, tends to be partially incompatible with aqueous solution and can undergo a phase change or phase separation during storage of the solution. The hydrotrope solubilizer maintains a single phase solution having the components uniformly distributed throughout the composition in an aqueous or non-aqueous form.

Preferred hydrotrope solubilizers are used at about 0.1 to 30 wt-% and include, for example, small molecule anionic surfactants and semi-polar nonionic surfactants. The most preferred range of hydrotrope solubilizers is about 1 to 20 wt-%. Hydrotrope materials are relatively well known to exhibit hydrotropic properties in a broad spectrum of chemical molecule types. Hydrotropes generally include ether compounds, alcohol compounds, anionic surfactants, cationic surfactants and other materials. One important hydrotrope solubilizer for use in this invention comprises an amine oxide material. The small molecule anionic surfactants include aromatic sulfonic acid or sulfonated hydrotropes such as $C_{1-5}$ substituted benzene sulfonic acid or naphthalene sulfonic acid. Examples of such a hydrotrope are xylene sulfonic acid or naphthalene sulfonic acid or salts thereof.

The semi-polar type of nonionic surface active agents include amine oxide hydrotropes such as tertiary amine oxides corresponding to the general formula:

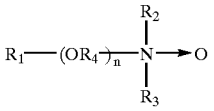

wherein n is 0 to 25 the arrow is a conventional representation of a semi-polar bond; and, $R_1$, $R_2$, and $R_3$ may be aliphatic, aromatic, heterocyclic, alicyclic, or combinations thereof. Generally, for amine oxides of detergent interest, $R_1$ is a branched or linear, aliphatic or alkyl radical of from about 8 to about 24 carbon atoms; $R_2$ and $R_3$ are selected from the group consisting of alkyl or hydroxyalkyl of 1–3 carbon atoms and mixtures thereof; $R_4$ is an alkylene or a hydroxyalkylene group containing 2 to 3 carbon atoms; and n ranges from 0 to about 20. Useful water soluble amine oxide hydrotropes are selected from alkyl di-(lower alkyl) amine oxides, specific examples of which are a $C_{10-14}$ iso-alkyl dimethyl amine oxide (iso-dodecyl) dimethyl amine oxide-Barlox 12i, n-decyldimethylamine oxide, dodecyldimethylamine oxide, tridecyldimethylamine oxide, tetradecyldimethylamine oxide, pentadecyldimethylamine oxide, hexadecyldimethylamine oxide, heptadecyldimethylamine oxide, octadecyldimethylamine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl) dodecylamine oxide, bis(2-hydroxyethyl)-3-dodecoxy-1-hydroxypropylamine oxide, dimethyl-(2-hydroxydodecyl) amine oxide and 3,6,9-trioctadecyldimethylamine oxide. The most preferred of the above is isododecyldimethylamine oxide (Barlox 12i). Other hydrotropes or couplers may be generally used in compositions of the present invention to maintain physical single phase integrity and storage stability. To this end, any number of ingredients known to those skilled in formulation art may be employed, such as monofunctional and polyfunctional alcohols. These preferably contain from about 1 to about 6 carbon atoms and from 1 to about 6 hydroxy groups. Examples include ethanol, isopropanol, n-propanol, 1,2-propanediol, 1,2-butanediol, 2-methyl-2,4-pentanediol, mannitol and glucose. Also useful are the higher glycols, polyglycols, polyoxides, glycol ethers and propylene glycol ethers. Additional useful hydrotropes include the free acids and alkali metal salts of sulfonated alkylaryls such as alkylated diphenyloxide sulfonates, toluene, xylene, cumene and phenol or phenol ether sulfonates or alkoxylated diphenyl oxide disulfonates (Dowfax materials); alkyl and dialkyl naphthalene sulfonates and alkoxylated derivatives.

Acidulants or alkaline agents are used to maintain the appropriate pH for the cleaners of the invention. Careful pH control can enhance cleaning. The acidic component or acidulant used to prepare the cleaners of the invention will comprise an acid which can be dissolved in the aqueous system of the invention to adjust the pH downward. Preferably, common commercially-available weak inorganic and organic acids can be used in the invention. Useful weak inorganic acids include phosphoric acid and sulfamic acid. Useful weak organic acids include acetic acid, hydroxyacetic acid, citric acid, tartaric acid and the like. Acidulants found useful include organic and inorganic acids such as citric acid, lactic acid, acetic acid, glycolic acid, adipic acid, tartaric acid, succinic acid, propionic acid, maleic acid, alkane sulfonic acids, cycloalkane sulfonic acids, as well as phosphoric acid and the like or mixtures thereof. Alkaline materials that can be used for pH adjustment include both weak and strong alkaline materials. Such materials include strong bases such as sodium hydroxide, potassium hydroxide, alkali metal salts such as sodium carbonate, potassium carbonate, sodium bicarbonate, potassium bicarbonate, sodium sesquicarbonate, organic bases such as triethanolamine, tripropanolamine, etc., alkali metal silicates, alkali metal salts generally.

In general, the pH of compositions can vary from a low of about pH 2.0 to a maximum of approximately 13.0 depending primarily upon the formulation choice Therefore the acid or alkaline agent or system is chosen accordingly. Depending on end use, the pH of the composition of the invention can vary widely. In aqueous systems used for laundry or hard surface cleaning the pH can be somewhat alkaline and can range from 7.5 and greater. In other end uses, an acid pH can be used when removal of soap scum or other soils that are associated with multiply charged cations such as $Ca^{2+}$ and $Mg^{2+}$ are present. In many applications, a pH that ranges somewhat around neutral is more desirable. These applications are for cleaning corrosion susceptible metallic surfaces such as aluminum, magnesium, etc. metal surfaces. For this application, a relatively neutral pH is desirable. Accordingly, for this type of application, the pH can range from greater than about 4 to less than about 10. The preferred pH range of compositions of this invention is typically from 7 to 13.5 most preferably, about 10 to 13. The compositions of the invention comprising a nonionic surfactant, a nonionic silicone surfactant and a hydrotrope can be directly contacted with the hard surface for the removal of organic, oily or greasy soils. Depending on substrate, such a composition can additionally include a chelating agent to have a final formulation comprising a nonionic surfactant and a nonionic silicone surfactant, a hydrotrope solubilizer and a chelating agent. These compositions can be used on substantially non-corrosive surfaces such as plastics, wood, coated wood, stainless steels, composite materials, fabrics, cement, and others.

The grease removing organic soil cleaning compositions of the invention can be used as a grease removing additive for a formulated cleaning material. Such cleaning materials are common in the industry and include hard surface cleaners, laundry detergents, general purpose cleaners for use in household and institutional applications, floor cleaners, glass cleaners, etc. The compositions of the invention are used as an additive by adding to a conventional cleaner formulation about 0.1 to about 20 wt % of the composition of the invention. We have surprisingly found that the materials of this invention, even when strongly diluted in aqueous solution alone or in a formulation such as a glass cleaner, hard surface cleaner, general purpose cleaner, or laundry detergent, can provide exceptional grease removal that is as nearly effective as the concentrate material. This finding that the material of the invention can be used as an additive and still retain substantial grease removing properties is a substantial surprise. We have also noted that these materials in aqueous solutions tend to be most effective when the proportions of the components of the invention, when dispersed or blended into aqueous compositions, retain a cloudy, opaque or semi-opaque appearance. We believe this appearance relates to the nature of the materials retaining a balance between the hydrophobic and a hydrophilic nature resulting in some cloudiness from the inability of the hydrophobic portions to fully dissolve in the aqueous material.

A typical formula for a laundry detergent typically comprises a source of alkali such as sodium hydroxide or sodium silicate, an anionic surfactant such as alkylbenzenesulfonate or an alkylsulfonate, a nonionic surfactant package, antiredeposition agents, fragrances, optical brightener solvents and other assorted formulation materials. Typical laundry detergents rely on the properties of the alkali material to swell the fibers and obtains substantial cleaning benefit from the anionic and nonionic surfactants that can effectively remove soils from the swelled fabric fibers. Hard surface cleaners often comprise, in an aqueous solution, a blend of anionic, nonionic and cationic surfactants often combined with an acid source, a base source, a solvent component and other formulatory ingredients to obtain a cleaner material that is targeted for particular soil on a hard surface material. Acid hard surface cleaners are formulated to remove cationic soils such as hardness components, soap scum, etc. Basic cleaners are often formulated to remove organic soils, food soils, and other organic or natural materials.

The compositions of the invention can be used full strength (neat, i.e. in the absence of an aqueous diluent). The compositions of the invention are directly applied to organic or greasy soils typically on a hard surface such as glass, metal, composite, wood, etc. surfaces. The compositions combined with the organic or greasy soils, tend to reduce any soil/hard surface interface bonding and reduce the cohesiveness of the complex soil and reduce the viscosity of the soil material, resulting in relative ease of physical removal. The compositions of the invention have attained a degree of cleanability unrecognized in prior degreasing, or organic removing detergent compositions.

Optional ingredients which can be included in the cleaning agents of the invention in conventional levels for use include solvents, processing aids, corrosion inhibitors, dyes, fillers, optical brighteners, germicides, pH adjusting agents (alkanolamines, sodium carbonate, sodium hydroxide, hydrochloride acid, phosphoric acid, etc.), bleaches, bleach activators, perfumes and the like.

The above discussion of certain components and formulations of the invention provide a basis for understanding these aspects of the invention. The following examples and data provide a basis for understanding the mode of operation of the invention in soil removal and disclose a best mode. These data result from screening tests run on a series of surfactants on their ability to remove the target complex organic semi-solid soil or cable grease from test items including laundry or stainless steel coupons.

Experimental

Evaluation of Compositions for Removing Complex, Organic or Greasy Soils in Laundry Applications The novel compositions were evaluated for removal of heavy stains and grease stains shadowing on polyester cotton fabrics (65/35 blend). The laundry detergent systems using the grease removing compositions of the invention were evaluated for cleaning properties. A test procedure was used in which multiple test shirts were used in each load. The shirts were uniformly soiled, cut in half, randomized and then washed in conventional washing and drying methods. The first half was washed in a low temperature, light-duty laundry formulation/method using the concentrate of the invention of Example 14 as surfactant additives. The second half was washed in a high temperature, heavy-duty laundry formulation/method using commercial nonionic-based surfactant additives with three times the actives level, as well as significantly more alkalinity. Both halves were evaluated by a skilled test panel for soil and stain removal. The typical load weight was 100 pounds, the washer was a conventional Wash X-125 unit. Conventional washing protocols were used. The washed clothes were washed, bleached, rinsed, contacted with an acid bath, rinsed, soured, extracted and dried. Surprisingly, the washing method using the degreaser organic soil removing additive compositions of the invention obtained stain removal that was noticeably improved when compared to fabric washed with the higher temperature, heavy-duty laundry formulation/method. This is all the more remarkable considering the substantially reduced energy use (lower temperature and less flushing) operation time, and fabric damage (less alkalinity) with the use of this invention.

TABLE 1

| RM | Ex 1 (wt %) | Ex 2 (wt %) | Ex 3 (wt %) | Ex 4 (wt %) | Ex 5 (wt %) |
|---|---|---|---|---|---|
| Soft water | 76.6 | 76.8 | 76.9 | 80.7 | 76.8 |
| Nonionic silicone surfactant TEGOPREN 5840 | 1.0 | 1.0 | 1.0 | 1.0 | 1.0 |
| Nonionic silicone surfactant ABIL B 8852 | 1.5 | 1.5 | 1.5 | 1.5 | 1.5 |
| DTPA, sodium salt 38% | 5.0 | 5.0 | 5.0 | 5.0 | |
| EDTA, sodium salt 40% | | | | | 5.0 |
| Isododecyl dimethyl Amine Oxide, 30% Barlox 12i | 2.5 | 2.5 | 2.5 | 2.5 | 2.5 |
| Citric Acid (Anh.) | 0.3 | 0.1 | 0.0655 | 0.07 | 0.1 |
| Nonionic blended surfactant BASF ES 8118 | 7.5 | 7.5 | 7.5 | | 7.5 |
| Dodecyl Mercaptan Ethoxylate Alcodet MC 2000 | | | | 7.5 | |
| Sodium Alkylated Diphenyl Oxide Disulfonates, 48% Dowfax Hydrotrope | 5.6 | 5.6 | 5.6 | 1.7 | 5.6 |
| Total | 100.0 | 100.0 | 100.0 | 100.0 | 100.0 |
| Observations @ RT | Clear | Clear | Clear | Clear | Clear |
| pH (conc) | 10.4 | 10.8 | 11.1 | 11.3 | 10.5 |
| pH (12.5 wt %) | 10.3 | 10.4 | 10.5 | 10.5 | 10.2 |

TABLE 2

CLEANER FOR HEAVILY SOILED METAL SURFACES

About 0.10 gm of DEL RAY black grease was applied on a series of 3 in. × 1.75 in. Stainless steel coupons. The soiled coupons were immersed into each test solution (see Column 1, Table 2) of product at controlled temperature of 75° F. (24° C. ± 2°) unless otherwise indicated a different temperature (1 hour test immersion). At test end coupons were rinsed 5 times with tap water and three times with DI water. Then they were dried overnight at about 120° F. (49° C.) in a laboratory oven.

| Products | pH | Before grease wt. | Overnight @ 120° F. (49° C.) grease removal | wt % removal | Solution |
|---|---|---|---|---|---|
| Ex 1 (conc) | 10.40 | 0.1065 | 0.0115 | 10.80 | Clear |
| Ex 1 (12.5 wt. %) | 10.25 | 0.1097 | 0.0221 | 20.15 | Cloudy |
| Ex 1 (12.5 wt %-120° F.) | 10.25 | 0.1035 | 0.0172 | 16.62 | Cloudy |
| Ex 2 (conc) | 10.78 | 0.1093 | 0.0108 | 9.88 | Clear |
| Ex 2 (12.5 wt. %) | 10.38 | 0.1005 | 0.0423 | 42.09 | Cloudy |
| Ex 2 (12.5 wt %-120° F.) | 10.38 | 0.1047 | 0.0499 | 47.66 | Cloudy |
| Ex 3 (conc) | 11.07 | 0.1159 | 0.0138 | 11.91 | Clear |
| Ex 3 (12.5 wt. %) | 10.53 | 0.1057 | 0.0520 | 49.20 | Cloudy |
| Ex 3 (12.5 wt. %-120° F.) | 10.53 | 0.1046 | 0.0539 | 51.53 | Cloudy |
| Ex 4 (conc) | 11.28 | 0.1267 | 0.0178 | 14.05 | Clear |
| Ex 4 (12.5 wt. %) | 10.51 | 0.1064 | 0.0093 | 8.74 | Clear |
| Ex 5 (conc) | 10.49 | 0.1120 | 0.0139 | 12.41 | Clear |
| Ex 5 (12.5 wt. %) | 10.20 | 0.1090 | 0.0344 | 31.56 | Cloudy |
| Ex 5 (12.5 wt %-120° F.) | 10.20 | 0.1130 | 0.0602 | 53.27 | Cloudy |

These data overall show the high effectiveness of the overall composition used as a concentrate (a neat application). More surprisingly, the compositions of the invention, when dissolved in an aqueous solution, forms a cloudy solution that is highly effective in soil removal. Example 5 shows that the dilute material at ambient temperatures is more than twice as effective in soil removal. The dilute material at just slightly elevated temperature of 120° F. (49° C.) is more than four times as effective. Both these aqueous solutions retain a cloudy appearance which is indicative of an effective cleaning composition that has a balance of ingredients with the right hydrophilic/hydrophobic balance for complex organic or greasy soil removal.

TABLE 3

| RM | Ex 6 (wt %) | Ex 7 (wt %) | Ex 8 (wt %) | Ex 9 (wt %) | Ex 10 (wt %) | Ex 11 (wt %) | Ex 12 (wt %) | Ex 13 (wt %) |
|---|---|---|---|---|---|---|---|---|
| Soft water | 76.8 | 76.8 | 76.8 | 76.8 | 76.8 | 76.62 | 76.62 | 76.62 |
| Nonionic Silicone Surfactant TEGOPREN 5840 | 1 | 1 | 1 | 1 | 1 | 1 | 1 | 1 |
| Nonionic Silicone Surfactant SILWET L-77 | | 1 | | | | | | |
| Nonionic Silicone Surfactant ABIL B 8852 | 1.5 | 1.5 | 1.5 | 1.5 | 1.5 | 1.5 | 1.5 | 1.5 |
| EDTA, Sodium Salt, 40% | 5 | 5 | 5 | 5 | 5 | 5 | 5 | 5 |
| Isododecyldimethyl amine oxide Barlox 12i | 2.5 | 2.5 | 2.5 | 2.5 | 2.5 | 2.5 | 2.5 | 2.5 |
| Anhydrous Citric Acid | 0.0945 | 0.0945 | 0.0945 | 0.0945 | 0.0945 | 0.0945 | 0.0945 | 0.0945 |
| Nonionic BASF ES 8118 | | 7.5 | | | | | | |
| Alkylated Diphenyl Oxide Disulfonate, 48% Dowfax Hydrotrope | 5.58 | 5.58 | 5.58 | 5.58 | 5.58 | 5.58 | 5.58 | 5.58 |
| Nonyl phenol (1.5) Ethoxylate | 7.5 | | 3.75 | | | | | |
| Nonyl phenol (4.5) Ethoxylate | | | | 3.75 | | 7.5 | 5.625 | |
| Nonionic PLURONIC P65 | | | 3.75 | 3.75 | 7.5 | | | |
| Nonionic PLURONIC 25R2 | | | | | | | 1.875 | 7.5 |
| Total | 100 | 100 | 100 | 100 | 100 | 100 | 100 | 100 |
| Observations @ RT | Insoluble | Clear | Insoluble | Clear | Clear | | | |
| pH (conc) | | 9.85 | 10.13 | 9.89 | 9.91 | | | |

TABLE 4

CLEANER FOR HEAVILY SOILED METAL SURFACES
0.10 gm of DEL RAY black grease applied on 3 × 1.75 in. ss coupons.
The soiled coupons were immersed into each test solution (see Column 1, Table 4) of product at controlled temperature of 75° F. (24° C. ± 2°) unless otherwise indicated a different temperature (1 hour immersion). At test end, coupons were rinsed 5× w/tap water and 3× w/DI water. Then they were dried overnight in 120° F. (49° C.) oven
1 hour test

| Products | Before grease wt. (gm) | Overnight @ 120° F. grease removal (gm) | wt % removal | Solution |
|---|---|---|---|---|
| Ex 6 (conc) | 0.1071 | −0.0050 | −4.67 | Insoluble |
| Ex 6 (12.5 wt. %) | 0.1150 | −0.0013 | −1.13 | Insoluble |
| Ex 6 (12.5 wt %-120° F.) | 0.1103 | −0.0100 | −9.07 | Insoluble |
| Ex 7 (conc) | 0.1134 | 0.0102 | 8.99 | Clear |
| Ex 7 (12.5 wt. %) | 0.1012 | 0.0351 | 34.68 | Cloudy |
| Ex 7 (12.5 wt %-120° F.) | 0.1175 | 0.0321 | 27.32 | Cloudy |
| Ex 8 (conc) | 0.1092 | 0.0160 | 14.65 | Insoluble |
| Ex 8 (12.5 wt. %) | 0.1204 | −0.0003 | −0.25 | Insoluble |
| Ex 8 (12.5 wt %-120° F.) | 0.1198 | −0.0046 | −3.84 | Insoluble |
| Ex 9 (conc) | 0.1097 | 0.0035 | 3.19 | Clear |
| Ex 9 (12.5 wt. %) | 0.1088 | 0.0218 | 20.04 | Slt. haze |
| Ex 9 (12.5 wt %)-120° F.) | 0.1161 | 0.0139 | 11.97 | Sltly. Cloudy |
| Ex 10 (conc) | 0.1046 | 0.0003 | 0.29 | Clear |
| Ex 10 (12.5 wt. %) | 0.1182 | 0.0009 | 0.76 | Clear |
| Ex 10 (12.5 wt %-120° F.) | 0.1171 | 0.0027 | 2.31 | Clear |

TABLE 4-continued

CLEANER FOR HEAVILY SOILED METAL SURFACES
0.10 gm of DEL RAY black grease applied on 3 × 1.75 in. ss coupons.
The soiled coupons were immersed into each test solution (see Column 1, Table 4) of product at controlled temperature of 75° F. (24° C. ± 2°) unless otherwise indicated a different temperature (1 hour immersion). At test end, coupons were rinsed 5× w/tap water and 3× w/DI water. Then they were dried overnight in 120° F. (49° C.) oven
1 hour test

| Products | Before | Overnight @ 120° F. (49° C.) | wt % removal | Solution |
|---|---|---|---|---|
| Ex 11 (conc) | 0.1041 | 0.0556 | 53.41 | Cloudy |
| Ex 11 (12.5 wt. %) | 0.1005 | 0.0179 | 17.81 | Cloudy |
| Ex 11 (12.5)-120° F. | 0.1015 | 0.0497 | 48.97 | Cloudy |
| Ex 12 (conc) | 0.1102 | 0.0304 | 27.59 | Clear |
| Ex 12 (12.5 wt. %) | 0.1115 | 0.0223 | 20.00 | Cloudy |
| Ex 12 (12.5 wt. %)-120° F. | 0.1099 | 0.0104 | 9.46 | Cloudy |
| Ex 13 (conc) | 0.1037 | −0.0001 | −0.10 | Haze |
| Ex 13 (12.5 wt. %) | 0.1195 | 0.0007 | 0.59 | Sltly. Cloudy |
| Ex 13 (12.5 wt. %)-120° F. | 0.1087 | 0.0002 | 0.18 | Cloudy |

The data of Table 4 show that the best cleaning materials are cleaners that are hazy or cloudy (but remain indefinitely stable) when used. Clear or completely insoluble materials appear to be ineffective in soil removal.

Example 14

| Raw Materials | Amount wt.-% |
|---|---|
| Soft Water | 79.5 |
| Pylaklor (Pink LX-10613) Dye | 0.0005 |
| Nonionic Silicone Surfactant TEGOPREN 5840 | 1.0 |
| Nonionic Silicone Surfactant ABIL B-8852 | 1.5 |
| Iso $C_{10-14}$ alkyldimethyl amine oxide-Barlox 12i | 7.5 |
| Nonionic Surfactant Blend BASF ES 8118 | 7.5 |
| Dowfax Hydrotrope | 3.0 |
| TOTAL | 100.0 |

TABLE 5

Removal Properties of Ex 5 on Semi-Polymerized Grease

| wt % Ex 5, Temp | Observations |
|---|---|
| Conc. (100 wt %), RT | At 9 min., wrinkles formed on the greased coupon in areas, where due to agitation of solution, more force was applied on that area. Wrinkles got heavier on plate. |
| 12.5 wt. %, RT | Some wrinkles started to appear on plate between 11–13 min. |
| 12.5 wt. %, 120° F. (49° C.) | At 4 min., grease started to wrinkle and easily came off. There were more wrinkles at 7 min. At 9 min., there were wrinkles and the grease shriveled up - implying that the soil-surface interface was fully affected, promoting soil removal |

By testing some of the key ingredients together in formulas, we discovered that a combination of a mixture of surfactants including silicone surfactants (such as TEGOPREN 5840 and ABIL B 8852), and one or more nonionic hydrocarbon surfactants at a specific ratio provided exceptional effectiveness. This mixture of nonionic hydrocarbon and silicone surfactants, when further combined with an effective hydrotrope (preferably containing an amine oxide, such as a combination of Barlox 12i and Dowfax Hydrotrope), are synergistic in removing the target cable grease comprising a lubricant oil and $MoS_2$.

We further learned that surprisingly:

(1) Certain compositions performed substantially as good, or even better at dilutions than when neat (at 100 wt % with no diluent). These always correlated with cloudy but stable form for the dilutions, and clear form for the 100 wt %, at the same test temperature; and (2) Slight adjustment in the overall hydrotroping condition, either by adjusting the form or level of electrolytes, or the choice or level of hydrotroping surfactant, can produce large change in performance. Again, better performance was closely tied to cloudy but stable form for the test solutions.

(3) The performance of Example 4 is what one usually expects—better soil removal at higher concentration than at lower concentration (14.05 wt % removal at 100 wt % concentration vs. 8.74 wt % removal at 12.5 wt. % concentration). The performance of Example 1, Example 2, Example 3, and Example 5, however, are surprising—radically better removal at lower concentration than at higher concentration. The performance results appear to correlate with the form of the test solutions (cloudy but stable form at 12.5 wt. % concentration vs. clear form at 100 wt % concentration). Furthermore, when the test temperature was increased from room temperature to 120° F. (49° C.), the soil removal was generally further improved, correlating with a generally more cloudy appearance at the higher temperature. The formulas Example 1, Example 2, Example 3 and Example 4, therefore, best exemplify this invention.

Another surprising finding is illustrated by comparing the results of Example 1 through 3. These are identical formulas except for very small differences in the level of citric acid for pH adjustment. Their performance results are virtually identical at 100 wt % concentrations (all clear solutions). Their performance results, however, are significantly different at 12.5 wt. % concentrations, again with better performance correlating with more cloudy solutions. Without being limited by theory, we speculate that more citric acid neutralizes more $Na_5DTPA$ to $Na_4HDTPA$, which is less effective in "salting out" the surfactants, making the test solution less cloudy and less effective. In other words, by adjusting the form/level of electrolyte, we can produce a large change in performance.

The test performance, however, does not correlate well with pH alone, as can be seen by comparing the results for Example 5 vs. Example 1. A 12.5 wt. % solution of the formulation in Example 5 has a slightly lower pH than 12.5 wt. % of the formulation in Example 1, yet the former substantially outperforms the latter at both room temperature and 120° F. (49° C.). Another example is that even though 12.5 wt. % Example 4 has a higher pH than either 12.5 wt. % Example 1 or 2 or 12.5 wt. % Example 5, it does not perform nearly as well.

Considerations for Chelating Agents

In this invention, the chelating agents serve three functions. One is to rip apart the divalent fatty acid salt in the cable grease, another is to "salt out" the surfactants, and a third is to provide alkalinity. Therefore, strong and multivalent chelating agents are the preferred choices. These include, but are not limited to the carboxylates, phosphonates, and polyphosphates. The most preferred chelating agents are the aminocarboxylates such as NTA, EDTA, DTPA, and TTHA. These data support this model of action.

Considerations for the Surfactants

Table 3 shows the compositions of Examples 6 through 13. Table 4 summarizes their removal test results on the target cable grease. These compositions were tested to better understand the best nonionic surfactant for use in the invention. In this invention, the surfactants have to wet, penetrate, emulsify, and remove the extremely hydrophobic cable grease. Without being limited by theory, we believe the silicone surfactants (TEGOPREN 5840 and ABIL B 8852) are excellent for wetting and spreading, and that they are highly effective with a conventional nonionic surfactant. We are not limited to TEGOPREN 5840 and ABIL B 8852 only, as illustrated by the successful replacement of TEGOPREN 5840 with SILWET L-77 in Example 7.

Again without being limited by theory, we believe the nonionic surfactant are most responsible for the penetration and emulsification of the target soil, and their hydrophilic/hydrophobic balance (HLB) appears to be the most important factor, as exemplified by the excellent results with BASF ES 8118. BASF ES 8118 is known to be a surfactant blend containing alkylphenol ethoxylate. In order to better understand the optimal HLB nonionic surfactant(s) to effect the removal of the target soil, we designed Examples 6 and 8 to contain NPE 1.5 (an HLB of 4.6), and Examples 9, 11 and 12 to contain NPE 4.5 (an HLB of 9.4). The results indicate that HLB about 9.4 is effective, while HLB about 4.5 is less effective. One surprising observation is that with NPE 1.5, most wt % removal values were negative, meaning that the soils actually gained weights. We speculate that one key factor is that the HLB of the surfactant actives needs to match that of the soil. Apparently, the HLB of NPE 4.5 matches well with that of the target cable grease. The HBL of NPE 1.5 apparently is too low and it penetrates too deep into the target cable grease and causes a weight gain. Correspondingly, the low HLB of NPE 1.5 also caused the compositions to be underhydrotroped such that they were insoluble and easily phase—separated.

Removal Results on Semi-Polymerized Grease

Table 5 summarizes the removal results of Example 5 on semi-polymerized grease. These results are excellent, all the more remarkable for a formula containing no strong source of alkalinity.

Ingredient Detail

The descriptions of the surfactants used are listed below:

TEGOPREN 5840, ABIL B 8852: Polysiloxane polyether copolymer (Goldschmidt Chem. Corp.)

SILWET L-77: Polysiloxane polyether copolymer (OSi Specialties, Inc.)

Hamp-ex 80: 40 wt % $Na_5$ diethylene triamine pentaacetate (Hampshire Chem. Co.)

Versene 100: 40 wt. % $Na_4$ ethylene diamine tetraacetate (Dow Chem. Co.)

Barlox 12i: 30 wt % iso-alkyl dimethyl amine oxide (Lonza Inc.)

BASF ES 8118: A surfactant blend containing alkyl phenol ethoxylate, possibly with a PLURONIC® type or a reverse (PLURONIC-R®) type and a polymeric anionic chelater (BASF Corp.).

Alcodet MC 2000: Polyoxyethylene thioether (Rhone Poulenc Inc.)

Dowfax Hydrotrope: 48 wt % benzene, 1,1'-oxybis-, sec-hexyl derivatives, sulfonated sodium salts (Dow Chem. Co.)

NPE 1.5: Nonylphenol (1.5) mole polyethoxy ether (multiple suppliers)

NPE 4.5: Nonylphenol (4.5) mole polyethoxy ether (multiple suppliers)

PLURONIC P65: Block copolymer of propylene oxide and ethylene oxide (BASF Corp.)

PLURONIC 25R2: Reverse block copolymer of ethylene oxide and propylene oxide (BASF Corp.)

This invention should be applicable on any highly hydrophobic soil. The data described above have shown it to be highly effective on cable grease as well as semi-polymerized triglyceride grease. It has also been found to be very effective in removing sulfur deposits on air scrubbers in rendering plants, and to be quite effective in removing road film on vehicles, as well as removing heavy floor soils.

Other applications of this invention include, but are not limited to, cleaning solutions for machine shops, auto repair shops, aircraft hangers, ship yards, etc., as well as manual warewashing, pots and pans soaking, presoaks, machine warewashing, CIP icleaning, laundry, general all purpose cleaning, window cleaning, bathroom and tile cleaning, kitchen and other floor cleaning, parking lots and drive through cleaning, graffiti removal, and stain removals.

The foregoing specification, examples and data provide a sound basis for understanding the technical advantages of the invention. However, since the invention can comprise a variety of embodiments, the invention resides in the claims hereinafter appended.

We claim:

1. A method of removing a complex soil from a hard surface, the method comprising:

(a) contacting the hard surface and the complex soil with a cleaner composition consisting essentially of:

(i) about 0.003 to 35 wt % of one or more nonionic surfactant;

(ii) about 0.0005 to 35 wt % of one or more silicone surfactant, the weight ratio of the nonionic surfactant to the silicone surfactant is such that there are about 1 to about 10 parts by weight of the nonionic surfactant per each part of the silicone surfactant; and (iii) about 0.001 to 20 wt % of a hydrotrope, selected from the group consisting of a $C_{1-5}$ substituted benzene sulfonic acid compound, a naphthalene sulfonic acid compound, a xylene sulfonic acid compound, a xylene sulfonic acid compound, a toluene sulfonic acid compound, a $C_{6-24}$ alkyl-dimethyl amine oxide, an alkylated diphenyl oxide disulfonate or salts thereof and mixtures thereof, in an amount sufficient to maintain the composition as a uniform solution wherein the nonionic surfactant, the silicone surfactant and the hydrotrope are selected in proportions that when contacted with an aqueous medium to make an aqueous dilution of the cleaner composition the aqueous dilution is cloudy and indefinitely stable;

(b) forming removed complex soil wherein the complex soil comprises an inorganic solid phase dispersed in an organic phase; and (c) removing the composition and removed soil.

2. The method of claim 1 wherein the composition also Comprises about 0.001 to 30 wt % of a chelating agent and the nonionic comprises a surfactant with an $(EO)_x$ group wherein x is greater than 2.

3. The method of claim 2 wherein the hydrotrope comprises a $C_{6-24}$ alkyl dimethyl amine oxide and the chelating agent comprises a carboxy substituted polymer composition.

4. The method of claim 1 wherein the hydrotrope comprises an iso-$C_{6-24}$ alkyl dimethyl amine oxide.

5. The method of claim 1 wherein the hydrotrope comprises an alkylated diphenyl oxide disulfonic acid or salt thereof.

6. The method of claim 1 wherein the nonionic surfactant comprises a block copolymer comprising at least a $(EO)_y$ $(PO)_z$ and a $C_{6-18}$ alkyl phenyl alkoxylate having 2 to 15 moles of EO wherein y and z are independently between 2 and 100.

7. The method of claim 1 wherein the silicone surfactant comprises a silicone backbone and at least one grafted alkylene oxide group having 2 to 100 moles of alkylene oxide.

8. The method of claim 7 wherein the grafted alkylene oxide group comprises $(EO)_n$ wherein n is 3 to 75.

9. The method of claim 1 wherein the aqueous dilution is cloudy as a result of the cloud point of the composition.

10. The method of claim 2 wherein the nonionic surfactant, the silicone surfactant, the hydrotrope, and the chelating agent are selected in proportions that when contacted with an aqueous medium to make an aqueous solution of the cleaner composition in the aqueous medium, the aqueous medium is cloudy as a result of the cloud point of the composition.

* * * * *

UNITED STATES PATENT AND TRADEMARK OFFICE

CERTIFICATE OF CORRECTION

PATENT NO. : 6,425,959 B1
DATED : July 30, 2002
INVENTOR(S) : Man

It is certified that error appears in the above-identified patent and that said Letters Patent is hereby corrected as shown below:

Column 5,
Line 60, "Organic chelatinagents" should read -- Organic chelating agents --

Column 8,
Line 65, "$(EO)_n$—$(P)O)_m$—$(EO)_n$" should read -- $(EO)_n$—$(PO)_m$—$(EO)_n$ --

Signed and Sealed this

Eighteenth Day of March, 2003

JAMES E. ROGAN
*Director of the United States Patent and Trademark Office*